United States Patent [19]

Tuggle

[11] 4,297,786

[45] Nov. 3, 1981

[54] CHAIN SAW NOSE GUARD

[75] Inventor: Lloyd H. Tuggle, Shreveport, La.

[73] Assignee: Beaird-Poulan Division, Shreveport, La.

[21] Appl. No.: 155,961

[22] Filed: Jun. 3, 1980

Related U.S. Application Data

[62] Division of Ser. No. 719,597, Sep. 1, 1976.

[51] Int. Cl.[3] ..... B27B 17/00

[52] U.S. Cl. ..... 30/382

[58] Field of Search ..... 30/382, 381, 371, 166; 151/68

[56] References Cited

U.S. PATENT DOCUMENTS

| | | | |
|---|---|---|---|
| 1,669,187 | 5/1928 | Campbell | 151/68 X |
| 3,098,511 | 7/1963 | Consoletti | 30/382 |
| 3,158,956 | 12/1964 | Gudmundsen | 30/371 |
| 3,713,466 | 1/1973 | Lund | 30/381 |
| 3,995,370 | 12/1976 | Allard | 30/382 |

*Primary Examiner*—Jimmy C. Peters

*Attorney, Agent, or Firm*—Hubbard, Thurman, Turner, Tucker & Glaser

[57] ABSTRACT

An assembly is provided which guards a curved portion of the guide bar tip of a chain saw in order to prevent kickback accidents. The guard assembly is attached on one side of the guide bar at a hole through the bar near the nose. It includes a plate which projects beyond the nose parallel with the plane of the guide bar. The plate has an internally threaded shaft projecting from it, allowing it to be bolted to the guide bar through the hole. A spacer between the plate and the guide bar holds the plate away from the cutting edge of the chain.

4 Claims, 7 Drawing Figures

CHAIN SAW NOSE GUARD

This is a division of application Ser. No. 719,597, filed Sept. 1, 1976.

BACKGROUND OF THE INVENTION

1. Field of the Invention

This invention relates to a guard assembly for the nose of a chain saw.

2. Description of the Prior Art

A well known safety problem in the use of a chain saw is the occurrence of "kickback". This is a violent movement of the saw which can occur when the nose, that is, the forward end of the saw, contacts a solid object. The conditions giving rise to kickback are as follows. The chain of the saw tends to bite into an object with a force proportional to the speed of the chain. At the same time, there is a corresponding reaction force exerted on the saw by the object. If the momentum of the chain and other moving parts of the saw carries the chain into the object, then the energy of the chain is expended in the cutting action and the reaction force on the saw is greatly reduced. However, at lower chain speeds, the momentum may not be sufficient to sustain the cutting action. In fact, the chain may become seized by the object. If the chain is not carried on through a cut, the saw is suddenly subjected to the full reactive force. When this force is exerted at the middle or on the upper quadrant of the nose of the saw, the nose moves suddenly upward in rotation generally about the rear of the saw.

Because of the way that a chain saw is held, the kickback motion is extremely difficult for the operator to control; thus there is considerable risk that he will be hit by the moving chain. If the saw is being held horizontally at the time of the kickback, then its motion will be somewhat opposed by the weight of the saw. This opposition decreases substantially as the saw is held more nearly vertically. For this reason, perhaps the most dangerous kickback situation is when the saw is being used to cut an object overhead. There may be additional lack of control in this situation if the operator's arms are extended to reach the object above.

One approach to minimizing the injurious effects of kickback is to employ a safety brake on the saw which quickly stops it when kickback occurs. A number of such brakes have been developed. This is a relatively elaborate and expensive partial solution to the problem. It stops the chain, but it does not prevent rotation of the saw. There is also the possibility that the saw will be damaged. Even under the best of circumstances, kickback represents a significant inconvenience.

SUMMARY OF THE INVENTION

The present invention provides a guard assembly which shields the cutting edge of the chain at the curved part of the guide bar tip of a chain saw in order to prevent cutting engagement by that portion of the chain. The guard assembly includes a plate and means for attaching the plate to the guide bar. Although the plate can be mounted on either side of the bar, it is preferably mounted on the flush cutting side of the bar. Means are provided for holding the plate away from the guide bar and thus away from the edge of the chain. The plate projects beyond the nose of the saw to guard it from contact.

Most of the advantages of the present invention flow from its simplicity. It is an extraordinarily inexpensive solution for the widespread safety hazard and inconvenience produced by kickback. It is compact and convenient to carry in the pocket for use on those occasions when it is needed. Attachment and detachment of the guard assembly is simple and does not require special tools. Because the plate shields the cutting edge around the nose, the saw may be safely used in restricted space situations where operation of a conventional bare-nosed saw would be hindered by abrasive obstructions.

Even though the guard assembly is inexpensive, its shape permits it to be built quite ruggedly. While the assembly is on the saw, the chain is within view and completely accessible. The guard does not accumulate an unusual amount of sawdust or debris; nor does it contribute to jamming.

BRIEF DESCRIPTION OF THE DRAWING

The nature of the invention, including its features and advantages as set forth above, may be understood more fully upon the consideration of particular embodiments. The following is a description of a preferred embodiment which includes instructions on how to make and use the invention. The description should be read in conjunction with the accompanying drawings, wherein.

DESCRIPTION OF THE PREFERRED EMBODIMENT

Figure 1:
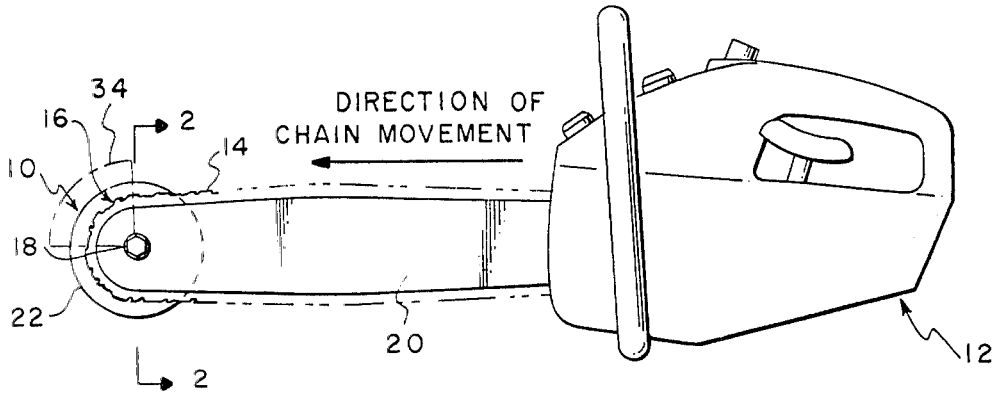
FIG. 1 is a side elevation of a guard assembly, constructed according to the teachings of the present invention, mounted on a chain saw.

In FIG. 1, a guard assembly, indicated generally by the reference numeral 10, is mounted on a chain saw 12. The chain saw 12 includes a chain 14 which is shielded and protected by the assembly 10. The protected zone is the periphery of a curved portion of the "nose" of the saw which is indicated generally by the reference numeral 16. A bolt 18 fastens the guard assembly 10 on a guide bar 20 near the center of curvature of nose 16. The guard assembly 10 includes a circular plate 22 which is concentric with the arc of nose 16, but projects beyond the nose.

Figure 2:
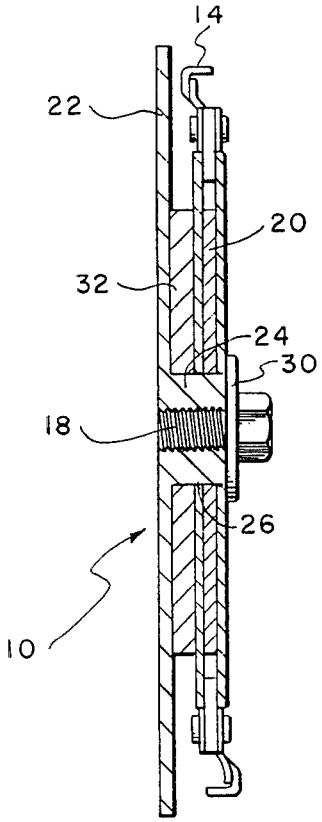
FIG. 2 is an enlarged section, taken along the line 2—2, showing the elements of the assembly and their relationship.

IN FIG. 2, the circular plate 22 is seen to have formed on it a shaft 24 which is inserted in a hole 26 through guide bar 20. Shaft 24 is internally threaded, and plate 22 is fastened to the guide bar 20 by the bolt 18 and a washer 30. An annular spacer 32 holds plate 22 away from guide bar 20 at a distance sufficient to clear chain 14.

Operation of the guard assembly 10 is based on the fact that plate 22 projects beyond nose 16 in parallel with the plane of the guide bar 20. The guard assembly thereby prevents the chain 14 from making the kind of solid contact with an object which causes kickback.

Variations are possible in the construction of guard assembly 10. Plate 22 may be made of any durable material such as metal or plastic. Although it is not necessary that plate 22 be circular, there are advantages in its being so. When the plate 22 is circular, its position of rotation about bolt 18 may shift during use, without affecting the operation of the guard assembly 10. Therefore in this embodiment only the single fastener, bolt 18, is required rather than some arrangement to absolutely fix the rotational position of the plate 22. This simplifies the process of mounting assembly 10 and allows its immediate use on those saws which are made with a single hold near the tip of the guide bar. Since a single fastener is used, the circular shape of plate 22 is additionally beneficial in minimizing the rotational forces on guard assembly 10, as it bumps into obstacles during use. Excessive rotation might tend to loosen bolt 18.

Figure 3:
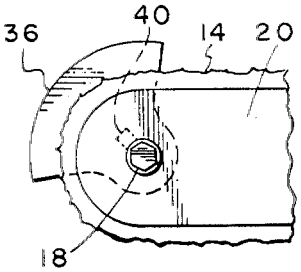
FIG. 3 is a side elevation of a preferred embodiment.
Figure 6:
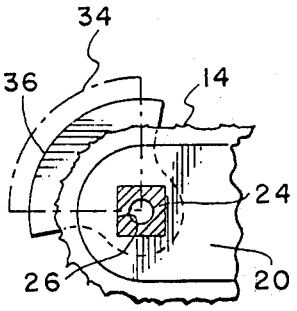
FIG. 6 is a side elevation, partly in section, of a preferred embodiment; and, FIG. 7 is a side elevation, partly in section, of a preferred embodiment.
Figure 4:
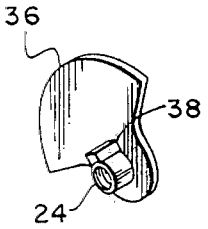
FIG. 4 is an isometric view of the plate of FIG. 3.
Figure 7:
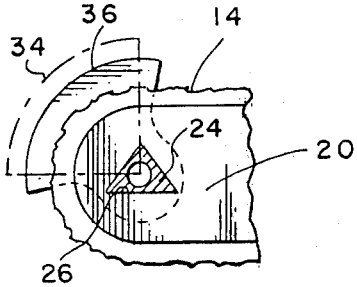
Figure 5:
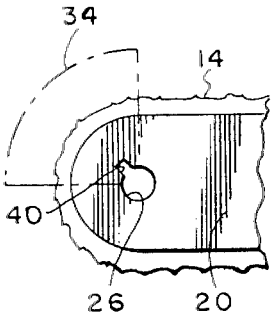
FIG. 5 is a side elevation of a portion of the guide bar of FIG. 3.

It has been determined that contacting or engaging the cutting edge of the chain 14 in the upper quadrant of the curved nose 16, the upper quadrant being indicated generally by the dashed line 34, causes the most dangerous kickbacks. Therefore it is essential that the critical area, quadrant 34, be shielded. Although the circular plate 22 completely shields the critical area, it also shields portions of the cutting edge outside of the critical area and thereby diminishes the effective cutting length of the saw. Thus it may be desirable to shield quadrant 34 with a plate 36 having the form of a sector which spans at least 90°, as illustrated in FIGS. 3 and 4. In this configuration, the plate 36 has a single axis of symmetry; therefore, its position relative to the critical area 34 must be fixed. Proper orientation and locking are provided by a locking tab or key 38 which is integrally formed as an offset portion of the shaft 24. The locking tab 38 fits into a hole 40 to provide the proper orientation of the sector plate 36 with respect to the critical quadrant 34. The registration of the tab 36 within the hole 40 prevents rotation of the plate with respect to the nose. Other shafts having a rectangular or triangular geometrical cross section as illustrated in FIGS. 6 and 7 do not require a tab for locking and orientation purposes and may be used to good advantage. For added safety, the span of plate 36 may include a few degrees on either side of the quadrant 34 as shown in FIGS. 6 and 7.

Various elements of the guard assembly 10 may be combined, in order to reduce the number of parts and thereby simplify mounting. For example, the separate spacer 32 could be replaced with a similary shaped spacing means formed on plate 22. Bolt 18 and washer 30 could be combined into a special bolt with a head the size of washer 30.

The shaft 24 acts as a fastener. In addition, its length and diameter are chosen so that the guard assembly 10 is made to satisfactorily fit the hole 26. Shaft 24 could be used without threads, if bolt 18 were made long enough to extend beyond plate 22, where the bolt could be fastened with a nut. In such an arrangement, shaft 24 would serve to protect the threads of bolt 18 from contact with the edges of hole 26 and assure a proper fit of the assembly 10 in hole 26. Alternatively, shaft 24, with threads, would be joined with washer 30, rather than plate 22. In this configuration, bolt 18 would be inserted from the side of the saw opposite that illustrated in FIG. 2, through a hole in plate 22.

Although preferred embodiments of the invention have been described in detail, it is to be understood that changes, substitutions, and alterations can be made therein without departing from the spirit and scope of the invention as defined by the appended claims.

What is claimed is:

1. In a chain saw having a guide bar and a cutting chain disposed around a curved nose portion of the guide bar, the curved nose portion including a hole and a quadrant having a curved edge which spans approximately the upper one half of the arc described by the curved nose portion when the guide bar is oriented to extend in a generally horizontal direction, a guard assembly attached to said nose portion and overlying said quadrant, said guard assembly comprising a sector of a substantially circular disk which spans an arc at least as large as the span of said quadrant but less than said arc described by said nose portion, the curved edge of said sector projecting beyond the cutting path of the chain in a plane substantially parallel to the plane of said guide bar, said sector including a shaft disposed in registration with said hole, said shaft having a portion defining a locking key, and said nose portion having surfaces defining at least a portion of said hole and cooperable with surface portions on said key to provide for said sector to be disposed in locked engagement with said nose portion to prevent rotation of said sector with respect to said guide bar and to prevent the installation of said sector on said guide bar out of a major portion of said quadrant.

2. The combination as defined in claim 1 wherein said surface portions on said key and said surfaces defining at least a portion of said hole comprise a plurality of cooperable intersecting planar surfaces.

3. The combination as defined in claim 2 wherein said hole is rectangular in profile and said portion of said shaft engaged by said hole is rectangular in cross section.

4. The combination as defined in claim 2 wherein said hole is triangular in profile and said portion of said shaft engaged by said hole is triangular in cross section.

* * * * *